US008087770B2

(12) United States Patent
Hiratsuka et al.

(10) Patent No.: US 8,087,770 B2
(45) Date of Patent: Jan. 3, 2012

(54) IMAGE FORMING APPARATUS AND IMAGE FORMING METHOD

(75) Inventors: Masashi Hiratsuka, Kanagawa (JP); Ken Hashimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 520 days.

(21) Appl. No.: 12/357,601

(22) Filed: Jan. 22, 2009

(65) Prior Publication Data

US 2010/0066771 A1 Mar. 18, 2010

(30) Foreign Application Priority Data

Sep. 17, 2008 (JP) ..... 2008-238095

(51) Int. Cl.
*B41J 2/01* (2006.01)
*B41J 2/195* (2006.01)

(52) U.S. Cl. ..... 347/102; 347/5; 347/6; 347/7; 347/95; 347/101; 347/103

(58) Field of Classification Search ..... 347/7, 102, 347/103
See application file for complete search history.

(56) References Cited

U.S. PATENT DOCUMENTS 6,460,973 B1 * 10/2002 Takahashi et al. ..... 347/55
6,716,562 B2 * 4/2004 Uehara et al. ..... 430/125.3
7,887,177 B2 * 2/2011 Doi et al. ..... 347/103
2001/0022607 A1 * 9/2001 Takahashi et al. ..... 347/103
2005/0253912 A1 * 11/2005 Smith et al. ..... 347/102
2006/0284951 A1 * 12/2006 Ikeda et al. ..... 347/103
2006/0286315 A1 * 12/2006 Hashimoto et al. ..... 428/32.34
2008/0032074 A1 * 2/2008 Doi et al. ..... 428/34.1
2009/0079807 A1 * 3/2009 Yamashita et al. ..... 347/102
2009/0091610 A1 * 4/2009 Doi et al. ..... 347/103
2009/0207226 A1 8/2009 Ikeda et al.

FOREIGN PATENT DOCUMENTS

JP 2006-250961 9/2006
JP 2007-102082 4/2007
JP 2007-168399 7/2007
JP 2007-307865 11/2007

* cited by examiner

*Primary Examiner* — Ryan Lepisto
(74) *Attorney, Agent, or Firm* — Fildes & Outland, P.C.

(57) ABSTRACT

An image forming apparatus includes a supply unit that supplies liquid recipient particles to receive liquid; a conveyance unit that conveys the liquid recipient particles supplied by the supply unit; a discharge unit that discharges liquid droplets to the liquid recipient particles conveyed by the conveyance unit; a humidity reducing unit that reduces relative humidity inside or around the supply unit; and a humidity increasing unit, on a downstream side of the supply unit, that increases relative humidity around at least one of the liquid recipient particles conveyed by the conveyance unit and the discharge unit.

20 Claims, 18 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2008-238095 filed Sep. 17, 2008.

BACKGROUND

1. Technical Field

The present invention relates to an image forming apparatus and an image forming method.

2. Related Art

An image forming apparatus is influenced by an environment upon image formation. Various methods to reduce such environmental influence and produce a good environment are known.

SUMMARY

According to an aspect of the invention, there is provided an image forming apparatus including: a supply unit that supplies liquid recipient particles to receive liquid; a conveyance unit that conveys the liquid recipient particles supplied by the supply unit; a discharge unit that discharges liquid droplets to the liquid recipient particles conveyed by the conveyance unit; a humidity reducing unit that reduces relative humidity inside or around the supply unit; and a humidity increasing unit, on a downstream side of the supply unit, that increases relative humidity around at least one of the liquid recipient particles conveyed by the conveyance unit and the discharge unit.

BRIEF DESCRIPTION OF THE DRAWINGS

Exemplary embodiments of the present invention will be described in detail based on the following figures, wherein.

DETAILED DESCRIPTION

Next, an exemplary embodiment of the present invention will be described based on the drawings.

Figure 1:
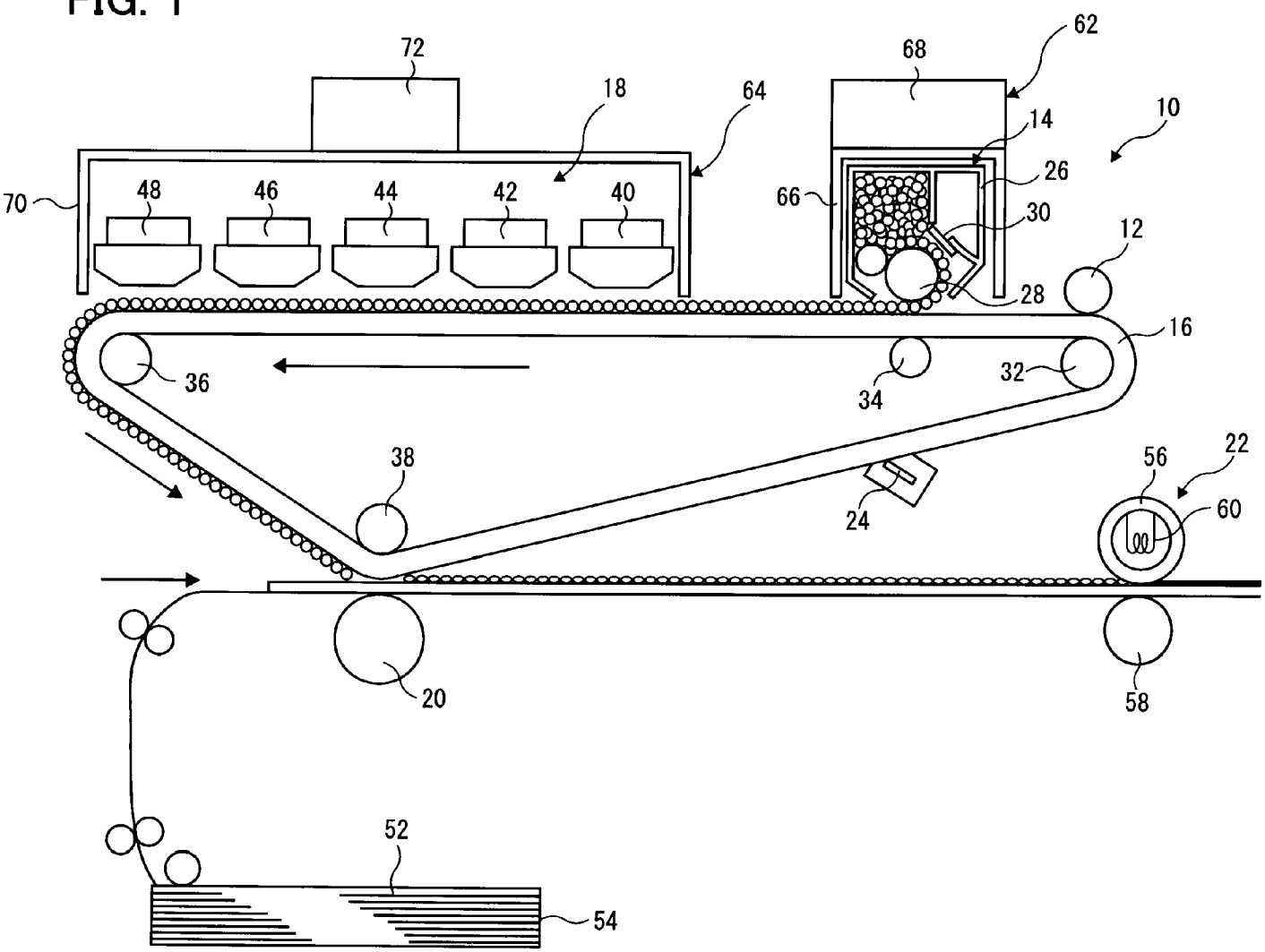
FIG. 1 is a cross-sectional view showing an image forming apparatus according to an exemplary embodiment of the present invention.

FIG. 1 shows the overview of an image forming apparatus 10 according to the exemplary embodiment of the present invention. The image forming apparatus 10 has a charging roller 12 as a charging unit, a particle supply device 14 as a supply unit, an intermediate transfer body 16 as a conveyance unit, an ink-jet printer 18 as a discharge unit, a transfer roller 20 as a transfer unit, a fixing device 22 as a fixing unit and a cleaning device 24 as a cleaning unit.

The charging roller 12 charges the surface of the intermediate transfer body 16. An elastic layer is formed on the outer peripheral surface of a main body of e.g. aluminum or stainless steel. As a charging unit, a unit which applies electric charge such as a corotron type charger or a scrotron type charger may be used in place of the charging roller 12. Otherwise, a friction charging unit using a brash or the like may be used.

The particle supply device 14 supplies liquid recipient particles to receive liquid. The particle supply device 14 has a supply device main body 26, a supply roller 28 and a charging blade 30 provided in the supply device main body 26. The supply device main body 26 contains the liquid recipient particles. The supply roller 28 is provided oppositely to the intermediate transfer body 16. The charging blade 30, with a predetermined biasing force to the supply roller 28, comes into contact with the rotating supply roller 28, charges the liquid recipient particles by friction, and regulates the layer thickness of the liquid recipient particles supplied by the supply roller 28. The liquid recipient particles are charged to an opposite polarity to that of the surface of the intermediate transfer body 16 charged by the charging roller 12, and supplied from the supply roller 28 to the intermediate transfer body 16. Note that though the liquid recipient particles themselves can be charged, it may be arranged such that carrier to charge the liquid recipient particles is put in the supply device main body 26, and the liquid recipient particles, as so-called two-component particles, are charged.

The intermediate transfer body 16 rotates counterclockwise as indicated with an arrow in the figure, attracts the liquid recipient particles supplied from the particle supply device 14 with an electrostatic force and conveys the liquid recipient particles. In the exemplary embodiment, a semiconductor member having a surface resistance of $10^{10}$ to $10^{14}$ Ω/□ and a sedimentary resistance of $10^{9}$ to $10^{13}$ Ω·cm, or an insulating member having a surface resistance of $10^{14}$ Ω/□ or higher and a sedimentary resistance of $10^{13}$ Ω·cm or higher, and having a form of an endless belt, is used. Further, as the intermediate transfer body 16, a material having mechanical strength and flexibility such as polyimide, polyamide-imide, aramid resin, polyethylene rephthalate, polyester, polyether sulfone, or stainless steel, is selected.

The intermediate transfer body 16 is supported with e.g. four support rollers 32, 34, 36 and 38. The first support roller 32, at the right end of the intermediate transfer body 16, is provided oppositely to the above-described charging roller 12 via the intermediate transfer body 16, to hold the intermediate transfer body 16 between the first support roller 32 and the charging roller 12. A voltage is applied to the charging roller 12, and the first support roller 32 is grounded, and the intermediate transfer body 16 is charged by a potential difference between the charging roller 12 and the first support roller 32. The second roller 34 is provided oppositely to the supply roller 28 of the particle supply device 14 via the intermediate transfer body 16. The third support roller 36 is provided at the left end of the intermediate transfer body 16. Further, the fourth support roller 38 at the lower end of the intermediate transfer body 16 is provided oppositely to the transfer roller 20 via the intermediate transfer body 16, to hold the intermediate transfer body 16 between the fourth support roller 38 and the transfer roller 20. Note that in the present exemplary embodiment, an endless belt is used as the intermediate transfer body 16, however, the intermediate transfer body 16 having a drum shape may be used as another exemplary embodiment.

The ink-jet printer 18 discharges liquid droplets (ink) to liquid recipient particles conveyed by the intermediate transfer body 16. The ink-jet printer 18 has e.g. five print heads 40, 42, 44, 46 and 48. The first print head 40 for yellow discharges ink including yellow color material. The second print head 42 for magenta discharges ink including magenta color material. The third print head 44 for cyan discharges ink including cyan color material. The fourth print head 46 for black discharges ink including black color material. The fifth print head 48 for transparent ink discharges transparent ink without color material. The liquid recipient particles to which the ink is applied become softened and the viscosity of the liquid recipient particles is increased.

Figure 2:
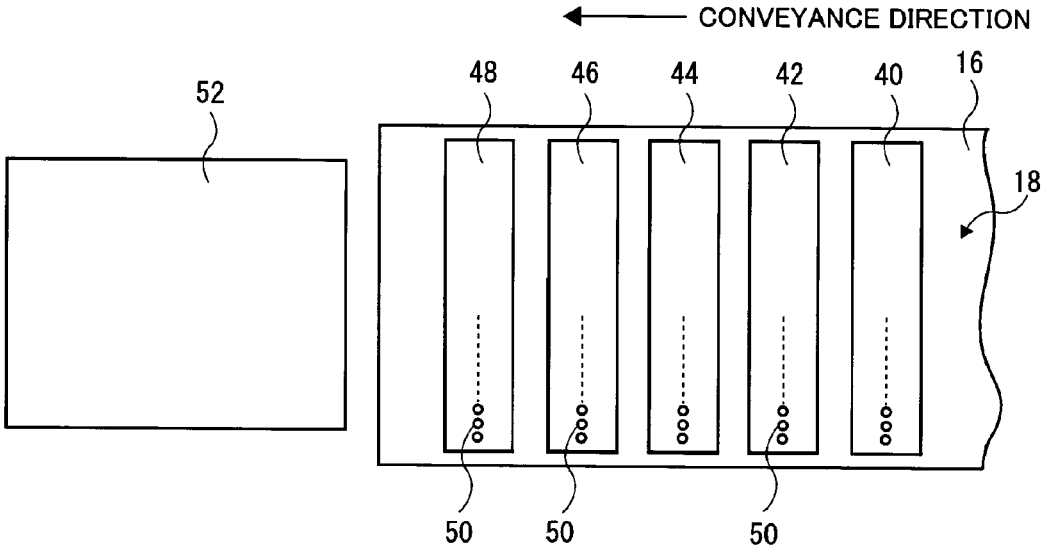
FIG. 2 is a plan view showing a full-line type ink-jet printer in the exemplary embodiment of the present invention.

As shown in FIG. 2, the respective print heads 40 to 48 are e.g. full-line type print heads arrayed in a direction orthogonal to a conveyance direction of the intermediate transfer body 16. In the respective print heads 40 to 48, a large number of discharge orifices 50 opened toward the intermediate transfer body 16, are formed along a lengthwise direction at e.g. 1200 dpi (dots per inch) intervals. The discharge orifices 50 are formed over a maximum width of a recording medium 52 on which an image is to be formed or a greater width. Further, driving elements (not shown) are provided in correspondence with the respective discharge orifices 50. The driving element is a heater element such as a piezoelectric element or a resistor. The driving element is driven and applies physical pressure or pressure by bubble to ink in correspondence with an image signal or non-image signal, thereby discharges ink from the discharge orifice 50. The first to fourth print heads 40 to 48 discharge ink to an image portion, and the fifth print head 48 discharges transparent ink to a non-image portion.

Figure 3:
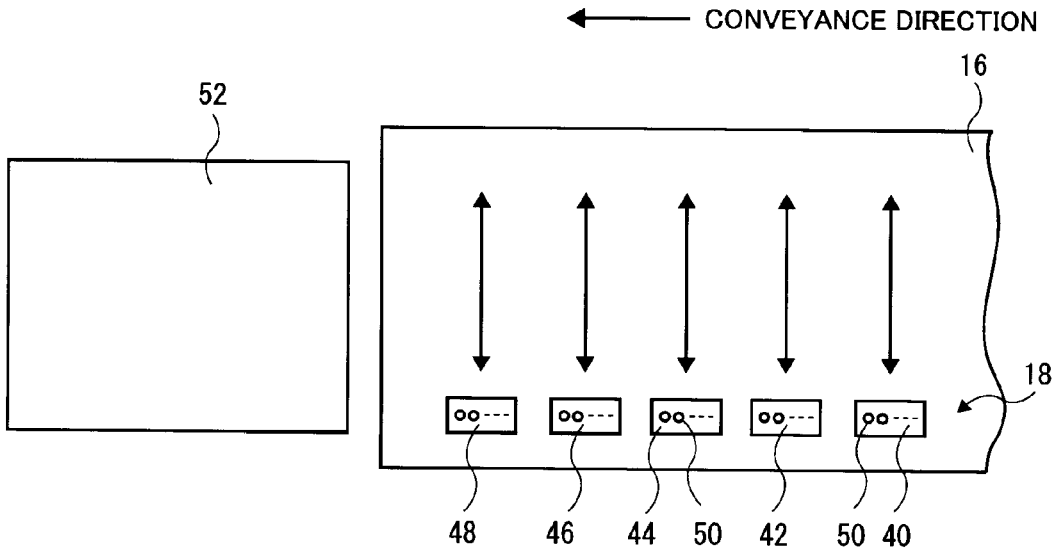
FIG. 3 is a plan view showing a scan-type ink-jet printer in the exemplary embodiment of the present invention.

Note that in the exemplary embodiment, the full-line type print heads 40 to 48 are used, however, as another exemplary embodiment, a scan type print heads may be used. In this case, as shown in FIG. 3, the print heads 40 to 48, provided with plural discharge orifices 50 formed in the conveyance direction of the intermediate transfer body 16, are scanned to reciprocate in a direction orthogonal to the conveyance direction of the intermediate transfer body 16, to form an image.

The transfer roller 20 is formed by coating the outer peripheral surface of e.g. a metal core with an elastic body such as silicone rubber, and further coating the outer peripheral surface of the elastic body with a noncohesive material such as PFA (Tetrafluoroethylene-perfluoroalkylvinylether copolymer). The recording medium 52 is supplied from a recording medium supply unit 54, and is conveyed to a position between the intermediate transfer body 16 and the transfer roller 20. A pressure force (of e.g. 0.5 MPa) acts between the transfer roller 20 and the fourth support roller 38, and the liquid recipient particles to which the ink is applied by the ink-jet printer 18 are crushed between the intermediate transfer body 16 and the transfer roller 20, and the liquid recipient particles are transferred to the conveyed recording medium 52.

Note that it maybe arranged such that the transfer roller 20 as a heating roller applies heat to the liquid recipient particles and transfers the heated the liquid recipient particles.

Since the softened liquid recipient particles are transferred to the recording medium 52, a permeable medium (e.g., normal paper or ink-jet coat paper) or a non-permeable medium (e.g., art paper or a resin film) may be used as the recording medium 52. Further, print transfer can be performed to a recording medium having a concavo-convex surface.

The fixing device 22 has a heating roller 56 provided on the side where an image is recorded and a pressure roller 58 provided on the side where an image is not formed. The heating roller 56 includes a heater 60 as a heat source. The heating roller 56 and the pressure roller 58 are respectively formed by coating the outer peripheral surface of e.g. a metal core with an elastic body such as silicone rubber, and further coating the outer peripheral surface of the elastic body with a noncohesive material such as PFA. The heating roller 56 and the pressure roller 58, in contact with each other with a pressing force, rotate in a direction to convey the recording medium 52. When the recording medium 52 is passed between the heating roller 56 and the pressure roller 58, the liquid recipient particles are fixed to the recording medium 52 with heat and pressure. In the fixing device 22, the surface temperature of the heating roller 56 is equal to or lower than 100° C., e.g., 95° C. The heating roller 56 and the pressure roller 58 are pressurized at e.g. 0.5 MPa, and rotated at a peripheral speed of 100 ms.

The cleaning device 24 is provided in the intermediate transfer body 16 on the downstream side of the transfer roller 20. The cleaning device 24 removes liquid recipient particles and other foreign materials (e.g. paper particles of a recording medium) remaining on the intermediate transfer body 16. The cleaning device 24, holding e.g. a blade, brings the end of the blade into contact with the intermediate transfer body 16, thereby scrapes off the liquid recipient particles and other foreign materials attached to the intermediate transfer body 16.

Next, the liquid recipient particles will be described. The liquid recipient particles, having ink receptibility, receive ink components when the ink is brought into contact with the liquid recipient particles. Note that the ink receptibility means a capability to hold at least a part (at least a liquid component) of the ink components. The liquid recipient particles include at least organic resin in which the percentage of polar monomer having a polar group to the entire monomer component is 10 to 90 mol %. More particularly, the liquid recipient particles have particles including e.g. the above organic resin (hereinbelow, referred to as "hydrophilic organic particles") (hereinbelow, the particles including the hydrophilic organic particles will be referred to as "mother particles").

When the liquid recipient particles are hydrophilic resin, the particles include at least organic resin in which the percentage of polar monomer to the entire monomer component is 10 to 90 mol %. The liquid recipient particles have higher viscosity in comparison with hydrophobic particles.

The hydrophilic resin may include a copolymer obtained from hydrophilic monomers and hydrophobic monomers. The hydrophilic monomers include a monomer having a hydroxyl group, and a monomer having a dissociable group. Further, the hydrophilic resin may include a graft copolymer or a block copolymer in which a starting unit such as a polymer/oligomer structure is copolymerized with another unit.

Examples of the monomer having a hydroxyl group (a hydrophilic monomer) include hydroxymethyl(meth)acrylate, 2-hydroxyethyl(meth)acrylate, 2-hydroxypropyl (meth) acrylate, 4-hydroxybutyl(meth)acrylate, 3-chloro-2-hydroxypropyl methacrylate, di-(ethyleneglycol) maleate, di-(ethyleneglycol)itaconate, 2-hydroxyethyl maleate, bis(2-hydroxyethyl)maleate, 2-hydroxyethylmethyl fumarate, ethyleneglycol mono(meth)acrylate, diethyleneglycol mono (meth)acrylate, 1,3-butyleneglycol mono(meth)acrylate, 1,6-hexanediol mono(meth)acrylate, neopentylglycol mono (meth)acrylate, trimethylolpropane mono(meth)acrylate, tetramethylolmethane mono(meth)acrylate, pentaerythritol mono(meth)acrylate, polyethyleneglycol mono(meth)acrylate, and hydroxyethyl acrylamide.

Examples of the monomer having a dissociable group (hydrophilic monomer) include a monomer having, as a dissociable group, an ethylene oxide group, a carboxylic acid group, a sulfonic acid group, or a substituted or unsubstituted amino group. When the ink receiving particles are positively charged, the monomer may be a monomer having a (substituted) amino group or a (substituted) pyridine group. When the ink receiving particles are negatively charged, the monomer may be a monomer having an organic acid group such as a carboxylic acid group or a sulfonic acid group. Specific examples thereof include a monomer having an -EO unit (ethylene oxide group), —COOM (where M is, for example, hydrogen, an alkali metal such as Na, Li and K, ammonia, or an organic amine), —$SO_3M$ (where M is, for example, hydrogen, an alkali metal such as Na, Li and K, ammonia, or an organic amine), —$NR_3$ (where R is, for example, H, alkyl or phenyl), and —$NR_4X$ (where R is, for example, H, alkyl or phenyl, and X is, for example, halogen, sulfate group, an acid anion such as carboxylic acid, or $BF_4$).

Specific examples of the monomer having a dissociable group (hydrophilic monomer) include acrylamide, acrylic acid, methacrylic acid, unsaturated carboxylic acid, crotonic acid and maleic acid. A carboxylic acid may be particularly advantageous in terms of storage stability because it tends not to dissociate due to humidity in the air but dissociates in ink (a slightly alkaline liquid) when it is not neutralized (when not having a salt structure). Further, carboxylic acid may be advantageous in terms of fixing property because it crosslinks (pseudo-crosslinks) via ions in ink and the entire system (ink+ink receiving particles) is easily fixed.

Examples of a hydrophilic unit or monomer to be used as a hydrophilic monomer component include cellulose derivatives such as cellulose, ethyl cellulose and carboxymethyl cellulose, starch derivatives, monosaccharides/polysaccharides derivatives, polymerizable carboxylic acids and (partially) neutralized salts thereof such as vinyl sulfonic acid, styrenesulfonic acid, acrylic acid, methacrylic acid and maleic acid (anhydride), vinyl alcohols, derivatives and onium salts thereof such as vinylpyrrolidone, vinylpyridine, amino(meth)acrylate and dimethylamino(meth)acrylate, amides such as acrylamide and isopropylacrylamide, polyethylene oxide chain-containing vinyl compounds, hydroxyl group-containing vinyl compounds, and polyesters composed of multifunctional carboxylic acid and polyhydric alcohol, particularly, branched polyester containing tri- or higher functional acid such as trimellitic acid as a component and containing terminal carboxylic acid and hydroxyl group in large quantities, and polyester containing a polyethylene glycol structure.

The hydrophobic monomers may be monomers having a hydrophobic group, and specific examples include olefin (ethylene, butadiene, or the like), styrene, α-methyl styrene, α-ethyl styrene, methyl methacrylate, ethyl methacrylate, butyl methacrylate, acrylonitrile, vinyl acetate, methyl acrylate, ethyl acrylate, butyl acrylate, lauryl methacrylate, and the like. Examples of a hydrophobic unit or monomer include styrene derivatives such as styrene, α-methyl styrene, vinyl toluene; vinyl cyclohexane, vinyl naphthalene, vinyl naphthalene derivatives, alkyl acrylate, phenyl acrylate, alkyl methacrylate, phenyl methacrylate, cycloalkyl methacrylate, alkyl crotonate, dialkyl itaconate, dialkyl maleate, polyethylene, ethylene/vinyl acetate, polyolefines such as polypropylene, or the like; and derivatives thereof.

Specific examples of the hydrophilic resin which is a copolymer of hydrophilic monomers and a hydrophobic monomer include a styrene/2-ethylhexyl (meth)acrylate/hydroxypropyl (meth)acrylate/(meth)acrylic acid copolymer, a styrene/2-ethylhexyl (meth)acrylate/hydroxypropyl (meth) acrylate/maleic acid copolymer, a styrene/hydroxybutyl (meth)acrylate/(meth)acrylic acid copolymer, and a styrene/hydroxybutyl(meth)acrylate/maleic acid copolymer.

The liquid recipient particles may have hydrophilic particles (initial particles) as mother particles or may have compound particles including groups of at least hydrophilic organic particles as mother particles.

Figure 4:
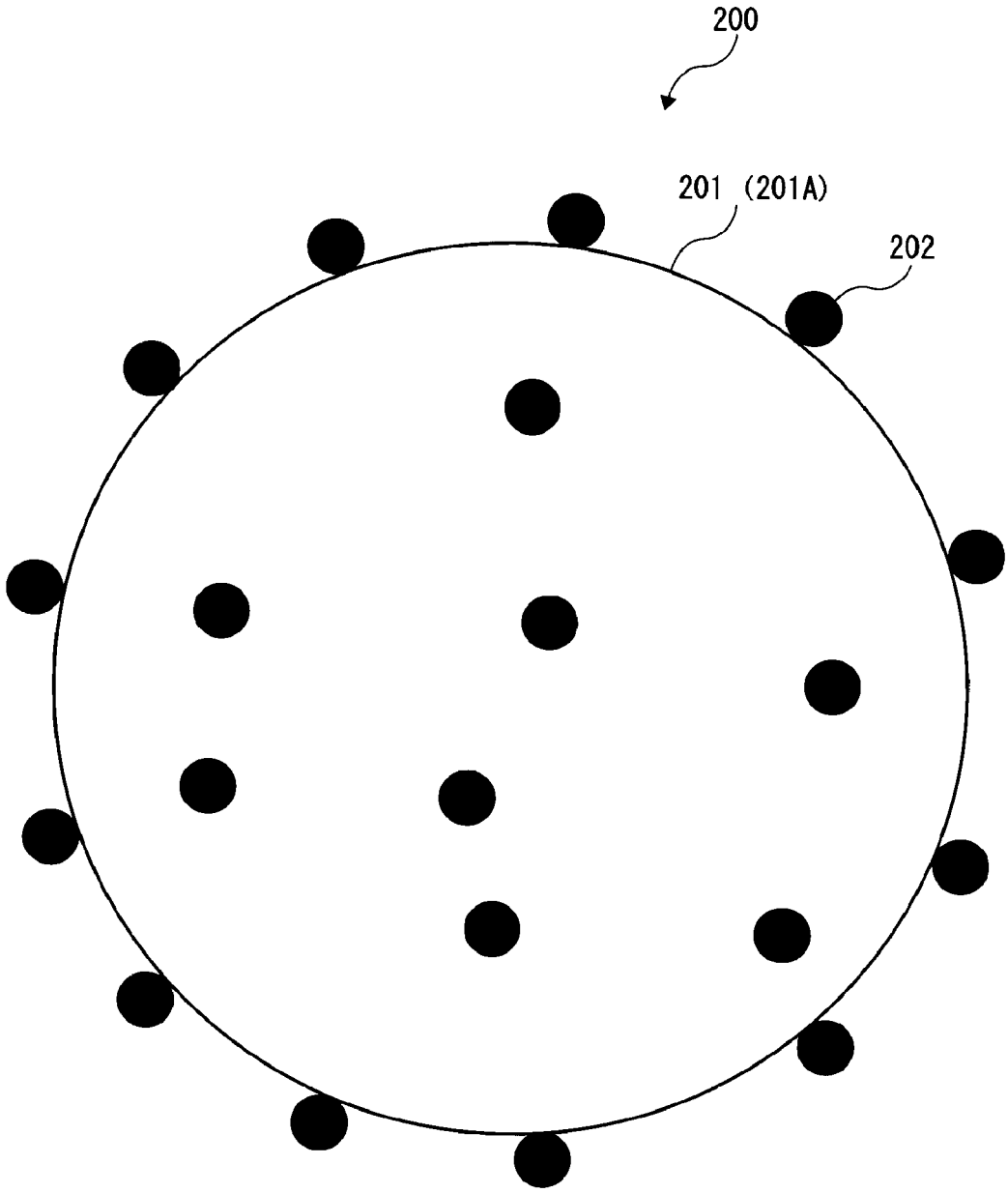
FIG. 4 is a conceptual diagram showing an example of liquid recipient particles in the exemplary embodiment of the present invention.
Figure 5:
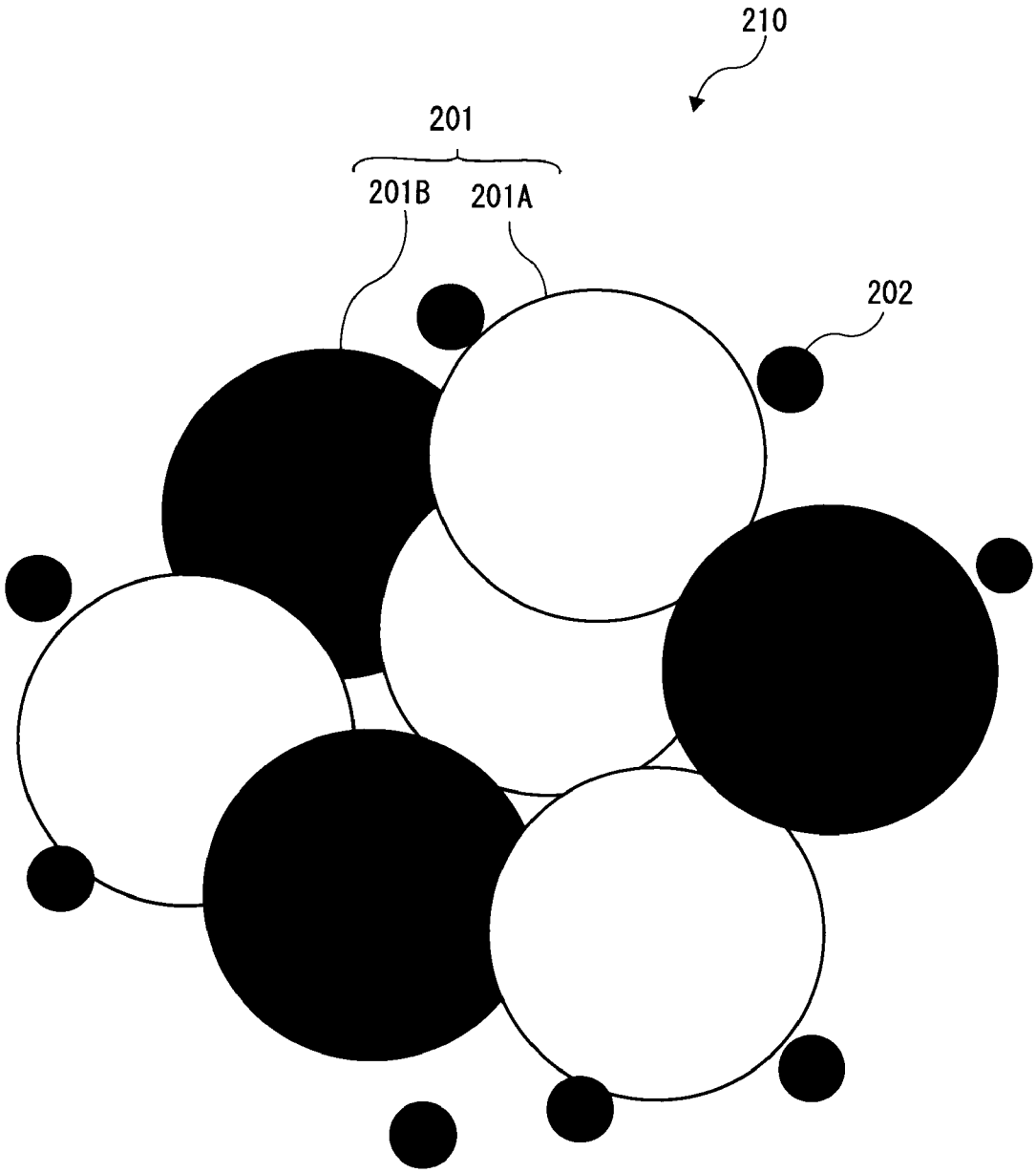
FIG. 5 is a conceptual diagram showing another example of the liquid recipient particles in the exemplary embodiment of the present invention.

As a particular example of the liquid recipient particles, FIG. 4 shows a liquid recipient particle 200 having a mother particle 201 which is a single hydrophilic organic particle 201A (initial particle) and inorganic particles 202 attached to the mother particle 201. Further, FIG. 5 shows a liquid recipient particle 210 having a compound particle of hydrophilic organic particles 201A and the inorganic particles 201B as the mother particle 201, and the inorganic particles 202 attached to the mother particle 201. Note that in this compound particle as a mother particle, an air space structure is formed with air gaps among the respective particles.

When the mother particle is a compound particle, the mass ratio between the hydrophilic organic particles to the other particles (hydrophilic organic particles: other particles) is 5:1 to 1:10 when the other particles are inorganic particles.

Further, as the particle diameter of the mother particle, the spherical reduced average particle diameter is within a range from e.g. 0.1 to 50 μm (desirably from 0.5 to 25 μm, or more desirably, from 1 to 10 μm).

Next, other additives of the liquid recipient particles will be described. First, it is desirable that the liquid recipient particles include a component to agglutinate or body up the ink component.

The component having this function may be included as a functional group of the resin (absorptive resin) of the above-described liquid recipient resin particle or as a chemical compound. As the functional group, carboxylic acid, polyvalent metal cation, polyamines and the like are given.

Further, as the chemical compound, a coagulating agent such as inorganic electrolyte, organic acid, inorganic acid or organic amine can be used.

As the coagulating agent, a single agent or a mixture of two or more agents may be used. Further, the content of the coagulating agent is desirably 0.01 to 30% by mass, or more desirably, 0.1 to 15% by mass, and further desirably, 1 to 15% by mass.

The liquid recipient particles may include a mold release agent. The mold release agent may be included in the above liquid absorptive resin, otherwise, particles of mold release agent may be compounded with hydrophilic organic resin particles and included in the liquid recipient particles.

As the ink in the exemplary embodiment, water-color ink is used. The water-color ink (hereinbelow, simply referred to as "ink") includes an ink solvent (e.g., water or a water soluble organic solvent) in addition to a recording material. Further, the ink may include other additives in accordance with necessity.

First, the recording material will be described. As the recording material, color material is given. As a color material, dyes and pigments can be used, however, pigments are appropriate. As pigments, organic pigments and inorganic pigments can be used. As a black pigment, carbon black pigments such as furnace black, lamp black, acetylene black and channel black can be given. In addition to pigments of black and three primary colors i.e. cyan, magenta and yellow, pigments of particular colors i.e. red, green, blue, brown and white, metal glossy pigments of gold, silver and the like, further, colorless or pale-color extender pigments, plastic pigments, and the like, maybe used. Further, newly synthesized pigments for the present invention may be used.

Further, particles formed by attaching a dye or pigment to the surface of a bead of silica, alumina, polymer or the like as a core, further, dye insoluble lakes, colored emulsions, colored latex and the like, may be used as the pigments.

As particular examples of the black pigment, Raven 7000 (manufactured by Columbian Chemicals Co.), Regal 400R (manufactured by Cabot), Color Black FW1 (manufactured by Degussa Corp.) and the like can be given, however, the black pigment is not limited to these pigments.

As particular examples of the cyan pigment, C.I. Pigment Blue-1, C.I. Pigment Blue-2, C.I. Pigment Blue-3, C.I. Pigment Blue-15, C.I. Pigment Blue-15:1, C.I. Pigment Blue-15:2, C.I. Pigment Blue-15:3, C.I. Pigment Blue-15:4, C.I. Pigment Blue-16, C.I. Pigment Blue-22, C.I. Pigment Blue-60 and the like can be given, however, the cyan pigment is not limited to these pigments.

As particular examples of the magenta pigment, C.I. Pigment Red-5, C.I. Pigment Red-7, C.I. Pigment Red-12, C.I. Pigment Red-48, C.I. Pigment Red-48:1, C.I. Pigment Red-57, C.I. Pigment Red-112, C.I. Pigment Red-122, C.I. Pigment Red-123, C.I. Pigment Red-146, C.I. Pigment Red-168, C.I. Pigment Red-177, C.I. Pigment Red-184, C.I. Pigment Red-202, C.I. Pigment Violet-19 and the like can be given, however, the magenta pigment is not limited to these pigments.

As particular examples of the yellow pigment, C.I. Pigment Yellow-1, C.I. Pigment Yellow-2, C.I. Pigment Yellow-3, C.I. Pigment Yellow-12, C.I. Pigment Yellow-13, C.I. Pigment Yellow-14, C.I. Pigment Yellow-16, C.I. Pigment Yellow-17, C.I. Pigment Yellow-73, C.I. Pigment Yellow-74, C.I. Pigment Yellow-75, C.I. Pigment Yellow-83, C.I. Pigment Yellow-93, C.I. Pigment Yellow-95, C.I. Pigment Yellow-97, C.I. Pigment Yellow-98, C.I. Pigment Yellow-114, C.I. Pigment Yellow-128, C.I. Pigment Yellow-129, C.I. Pigment Yellow-138, C.I. Pigment Yellow-151, C.I. Pigment Yellow-154, C.I. Pigment Yellow-180 and the like can be given, however, the yellow pigment is not limited to these pigments.

Note that when pigments are used as color materials, pigment dispersants may also be used. As a usable pigment dispersant, a polymer dispersant, an anionic surfactant, a cationic surfactant, an amphoteric surfactant, a nonionic surfactant and the like can be given.

As the polymer dispersant, a polymer having a hydrophilic structural element and a hydrophobic structural element may be used. As such polymer having a hydrophilic structural element and a hydrophobic structural element, a condensation polymer and an addition polymer can be used. As the condensation polymer, a publicly-known polyester dispersant can be given. As the addition polymer, a monomer addition polymer having an $\alpha$, $\beta$-ethylene unsaturated group can be given. A desired polymer dispersant can be obtained by copolymerizing a monomer having an $\alpha$, $\beta$-ethylene unsaturated group having a hydrophilic group with a monomer having an $\alpha$, $\beta$-ethylene unsaturated group having a hydrophobic group. Further, a monomer having an $\alpha$, $\beta$-ethylene unsaturated group having a hydrophilic group as a single polymer can be used.

As the above-described polymer dispersant, dispersants having e.g. 2000 to 5000 weight average molecular weight can be given.

These pigment dispersants may be used as a single dispersant or as a combination of two or more dispersants. Although the amount of addition of the pigment dispersant greatly differs in accordance with pigment, generally 0.1 to 100% by mass to a pigment can be given.

Further, a pigment which is water self-dispersible can be used as a color material. The water self-dispersible pigment, having a large number of solubilization groups to water on the pigment surface, disperses in water without polymer dispersant. More particularly, such water self-dispersible pigment can be obtained by performing surface modification treatments such as acid/base treatment, coupling agent treatment, polymer graft treatment, plasma treatment and oxidation/reduction treatment, on a general, so-called pigment.

Further, resin-coated pigments and the like can be used. As such pigment, called a microcapsule pigment, in addition to commercially-available microcapsule pigments manufactured by DIC Corporation, Toyo Ink MFG. Co., Ltd., and the like, microcapsule pigments pre-manufactured for the present invention can be used.

Further, resin dispersed pigments in which high polymer is physically adsorbed to or chemically combined with the above-described pigments can be used.

As further recording materials, dyes such as a hydrophilic anion dye, a direct dye, a cation dye, a reactive dye, a high polymer dye and the like, oil soluble dyes and the like, dye-colored wax powder, resin powder and emulsions, fluorescence dyes and fluorescence pigments, infrared ray absorbers, ultraviolet absorbers, magnetic bodies such as ferromagnetic materials represented by ferrite or magnetite, semiconductors represented by titanium oxide or zinc oxide, photocatalysts, other organic and inorganic electronic material particles, can be given.

As the content (concentration) of the recording material, e.g. 5 to 30% by mass to ink can be given.

As the volume average particle diameter of the recording material, e.g. 10 to 100 nm can be given.

The volume average particle diameter of the recording material is a particle diameter of the recording material itself, otherwise, when an additive such as a dispersant is attached to the recording material, the particle diameter of the recording material to which the additive is attached. As a device to measure the volume average particle diameter, a microtrack UPA size analyzer 9340 (manufactured by Leeds & Northrup) is used. Four ml of ink is poured into a measurement cell and measurement is performed in accordance with a predetermined measurement method. Note that as input values upon measurement, ink viscosity is inputted as viscosity, and the density of dispersed particles is inputted as the density of the recording material.

Next, the water soluble organic solvents will be described. As such water soluble organic solvents, polyvalent alcohols, polyvalent alcohol derivatives, nitrogenous solvents, alcohols, sulfosolvents and the like are used.

As other water soluble organic solvents, a propylene carbonate, an ethylene carbonate and the like can be used.

At least one type of the water soluble organic solvents may be used. As the content of the water soluble organic solvent, e.g. 1 to 70% by mass can be given.

Next, water will be described. As the water, especially to prevent mixture with impurities, it is desirable to use ion exchanged water, extra pure water, distilled water or ultrafiltered water.

Next, the other additives will be described. A surfactant can be added to the ink.

As the types of the surfactants, various types of anion surfactants, nonionic surfactants, cationic surfactants, amphoteric surfactants and the like can be given. An anionic surfactant or nonionic surfactant may be better used.

A single surfactant may be used or a combination of these surfactants may be used. Further, the hydrophile-lipophile balance (HLB) of the surfactant is desirably from 3 to 20 in consideration of solubility or the like.

The amount of addition of the surfactant is desirably 0.001 to 5% by mass, or more desirably 0.01 to 3% by mass.

Further, as other additives, a penetrant for penetrability control, polyethylene imine, polyamines, polyvinyl pyrrolidone, polyethylene glycol, ethyl cellulose, carboxymethyl cellulose or the like for control of characteristic such as improvement in ink dischargeability, an alkaline metal chemical compound such as potassium hydroxide, sodium hydroxide or lithium hydroxide for electric conductivity or pH control, and further, a pH buffer agent, an antioxidant, a fungicide, a viscosity modifier, an electro-conduction material, an ultraviolet absorber, a chelating agent and the like, can be added in accordance with necessity.

Next, characteristics of the ink will be described. First, the surface tension of the ink is 20 to 45 mN/m.

Note that as the surface tension, a value measured by using a Wilhelmy surface tensiometer (produced by Kyowa Interface Science Co., Ltd.) in an environment at 23° C. and 55% RH is used.

The viscosity of the ink is 1.5 to 30 mPa·s.

Note that as the viscosity, a value obtained by measurement using a measuring instrument, Rheomat 115 (manufactured by Contraves) at a measurement temperature of 23° C. and a shear rate of 1400 $s^{-1}$ is used.

Note that the ink is not limited to the above-described composition. For example, in addition to the recording material, the ink may contain functional materials such as liquid crystal materials or electronic materials.

Returning to FIG. 1, the image forming apparatus 10 will be further described. As described above, in the exemplary embodiment, in the liquid recipient particles, liquid absorptive resin is used. The particle supply device 14 charges the liquid recipient particles using the liquid absorptive resin, and forms e.g. about 4 layers of the liquid recipient particles on the intermediate transfer body 16. When the humidity in or around the particle supply device 14 is high, the liquid recipient particles absorb a moisture content, and an excellent electrostatic property cannot be maintained, and further, the liquid recipient particles become softened and coagulated, thereby disturb appropriate layer formation.

Further, in the present exemplary embodiment, as the ink discharged from the ink-jet printer 18, water-color ink is used. When the humidity around the ink-jet printer 18 is low, the ink at the discharge orifice 50 easily dries or bodies up, which causes ink discharge failure and poor discharge directionality.

Further, in the present exemplary embodiment, the fixing device 22 to generate heat is used so as to fix the liquid-absorbed liquid recipient particles to a recording medium. Accordingly, the temperature and humidity are increased in the image forming apparatus 10. To suppress the rise of the temperature and humidity inside the image forming apparatus 10, a ventilating device is provided. However, in the high-speed image forming apparatus 10, ventilation cannot be sufficiently performed and heat and a moisture content are increased. Accordingly, a uniform high-temperature and high-humidity environment is produced in the image forming apparatus 10.

Accordingly, in the present exemplary embodiment, a humidity reduction device 62 to reduce the relative humidity inside or around the particle supply device 14 and a humidity increasing device 64 to increase the relative humidity around the ink-jet printer 18 are provided so as to establish appropriate environments for the particle supply device 14 and the ink-jet printer 18.

The humidity reduction device 62 has a humidity reduction device main body 66 surrounding the particle supply device 14 and a blow part 68 to send dehumidified air or heated air into the humidity reduction device main body 66. In the humidity reduction device main body 66, the blow part 68 is connected to an upper part of the main body 66, and a lower part of the main body 66 is opened toward the intermediate transfer body 16. The humidity reduction device main body 66 prevents moisture absorption by the liquid recipient particles supplied to the intermediate transfer body 16 by the particle supply device 14 with the dehumidified air or heated air sent from the blow part 68, thereby maintains the electrostatic property of the liquid recipient particles.

Note that in the present exemplary embodiment, the relative humidity around the humidity reduction device 62 is reduced, however, as another exemplary embodiment, it may be arranged such that dehumidified air or heated air is sent into the particle supply device 14 to reduce the relative humidity inside the particle supply device 14.

The humidity increasing device 64 has a humidity increasing device main body 70 surrounding the ink-jet print 18 and a blow part 72 to send humidifying air or cooling air into the humidity increasing device main body 70. In the humidity increasing device main body 70, the blow part 72 is connected to an upper part of the main body 70, and a lower part of the main body 70 is opened toward the intermediate transfer body 16. The humidity increasing device main body 70 prevents drying or bodying of ink at the discharge orifice 50 of the ink-jet printer 18 with the humidifying air or cooling air sent from the blow part 72, thereby maintains excellent ink discharge performance of the ink-jet printer 18.

Figure 6:
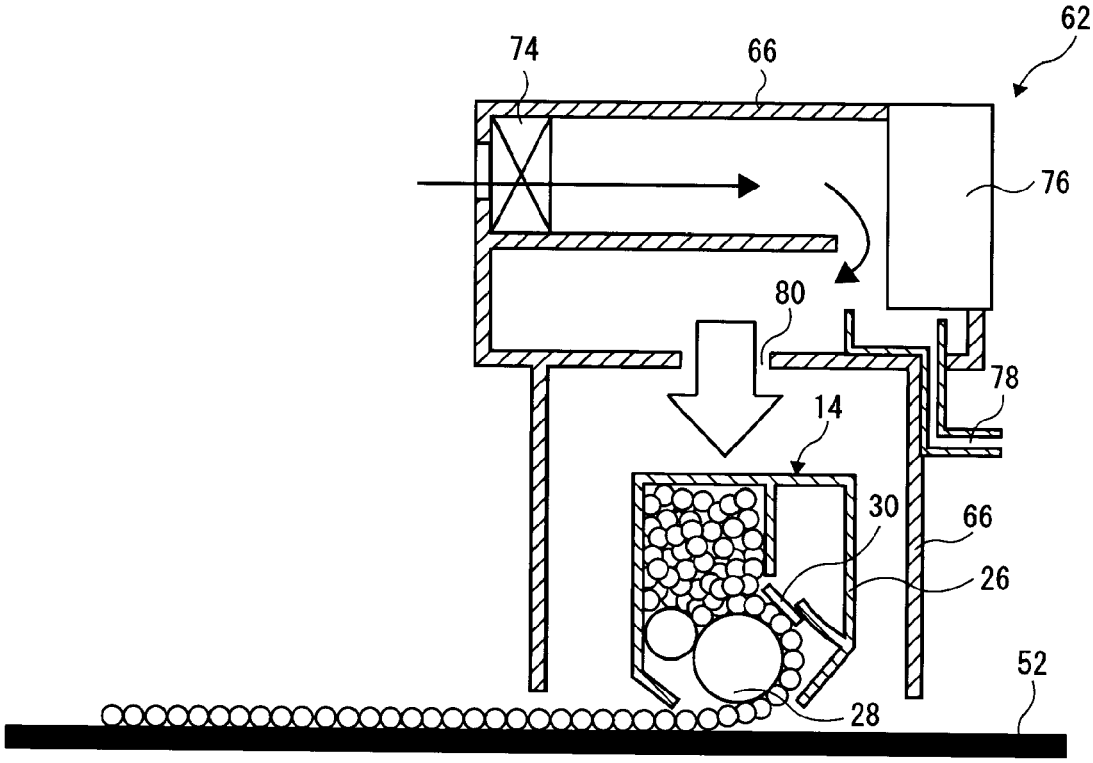
FIG. 6 is a cross-sectional view showing a first particular example of a humidity reduction device in the exemplary embodiment of the present invention.

FIG. 6 is a cross-sectional view showing a first particular example of the humidity reduction device 62. The humidity reduction device 62 is a humidity reduction unit to humidify air to be supplied around the particle supply device 14. That is, a blow part 66 has an air blower 74 to supply air from the outside of the device and a dehumidifier 76 to dehumidify the air sent by the air blower 74. The dehumidifier 76 which is e.g. a Peltier element cools an air blow surface by passing a direct current through the Peltier element. A moisture content bedewed in the dehumidifier 76 is discharged via a drain 78. The air dehumidified by the dehumidifier 76 is supplied around the particle supply device 14 via a supply port 80.

Figure 7:
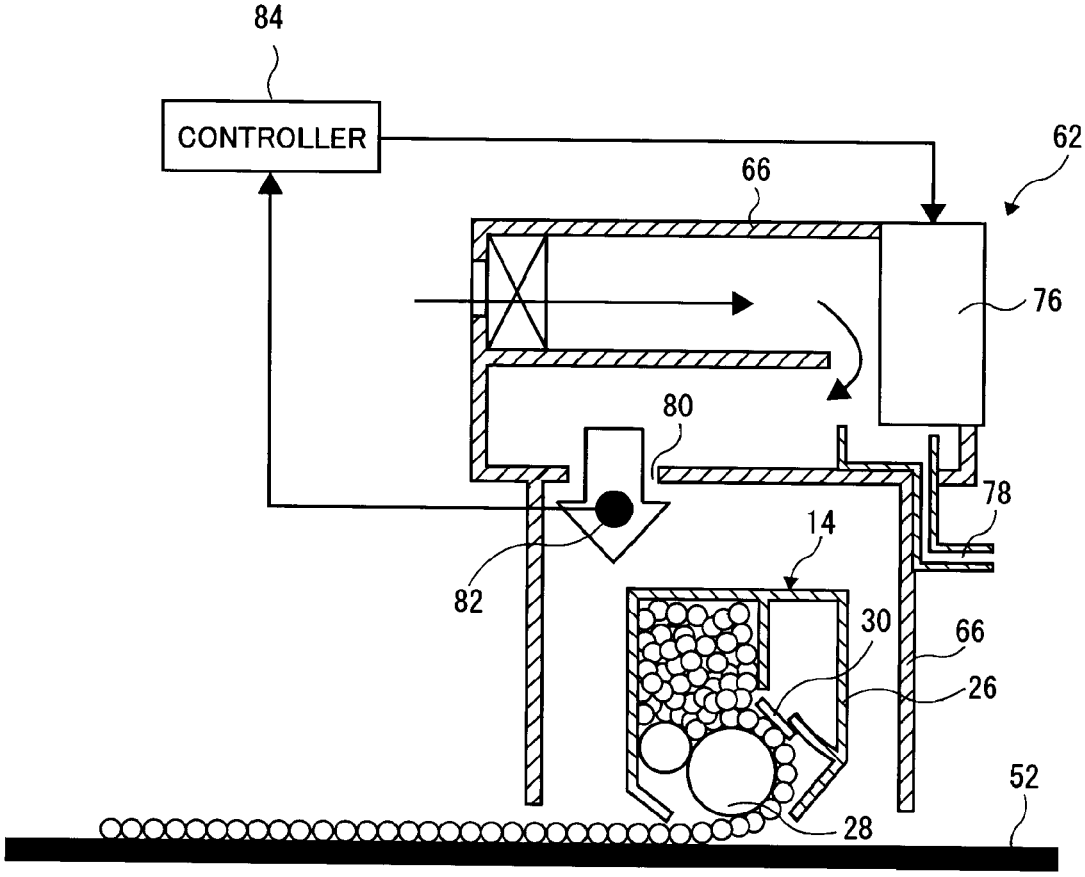
FIG. 7 is a cross-sectional view showing a modification of the first particular example of the humidity reduction device in the exemplary embodiment of the present invention.

The humidity reduction device 62 may always supply dehumidified air without particular humidity control, however, as shown in FIG. 7, automatic control can be realized by providing a humidity sensor 82. The humidity sensor 82, provided e.g. in the vicinity of the supply port 80, detects the relative humidity of the air supplied via the supply port 80. The humidity detected by the humidity sensor 82 is inputted into a controller 84 having e.g. a CPU. The controller 84 controls the dehumidifier 76 based on the humidity detected by the humidity sensor 82.

Figure 8:
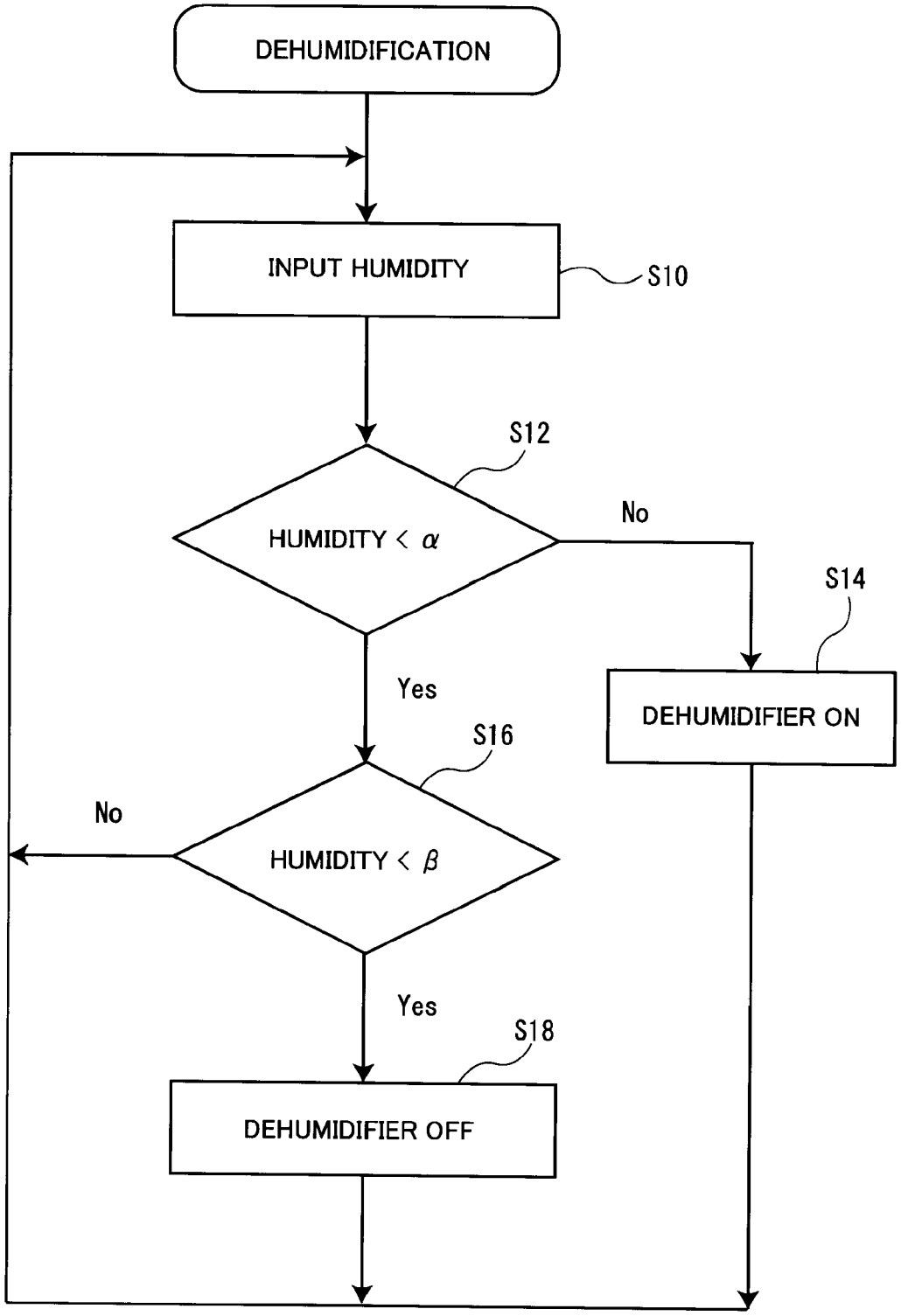
FIG. 8 is a flowchart showing a control operation in the modification of the first particular example of the humidity reduction device in the exemplary embodiment of the present invention.

FIG. 8 is a flowchart showing a control operation of the controller 84. At step S10, the controller 84 inputs humidity from the humidity sensor 82. Next, at step S12, it is determined whether or not the input relative humidity is lower than a predetermined value $\alpha$. When it is determined that the input relative humidity is equal to or higher than the predetermined value $\alpha$ (No), the process proceeds to step S14, at which a direct current is passed through the dehumidifier 76 which is e.g. a Peltier element, then the process returns to step S10. On the other hand, when it is determined that the input relative humidity is lower than the predetermined value $\alpha$ (Yes), the process proceeds to step S16, at which it is determined whether or not the relative humidity inputted at step S12 is lower than a predetermined value $\beta$ lower than the predetermined value $\alpha$. When it is determined at step S16 that the input relative humidity is lower than the predetermined value $\beta$ (Yes), the process proceeds to step S18, at which energization of the dehumidifier 76 with the direct current is stopped, and the process returns to step S10. On the other hand, when it is determined at step S16 that the input relative humidity is equal to or higher than the predetermined value $\beta$ (No), the process returns to step S10. The energization of the dehumidifier 76 with the direct current is stopped when the relative humidity is lower than $\beta$ lower than $\alpha$ so as to reduce energy consumption while prevent chattering in the energization of the dehumidifier 76.

As a result of the above control, air supplied to the supply port 80 is always lower than the predetermined value $\alpha$. The predetermined value $\alpha$ is e.g. 30%. When the relative humidity around the particle supply device 14 can always be lower than 30%, empirically, in this environment, moisture absorption to disturb the electrostatic property and liquidity of the liquid recipient particles does not occur. On the other hand, when the humidity around the particle supply device 14 is equal to or higher than 30%, a problem may occur in the electrostatic property and the liquidity of the liquid recipient particles.

Note that in the above exemplary embodiment, the energization of the dehumidifier 76 is ON/OFF controlled, however, the energization control is not limited to this arrangement. For example, the level of the direct current supplied to the dehumidifier 76 may be controlled.

Further, in the above exemplary embodiment, the relative humidity is detected by the humidity sensor 82, however, the detection of the relative humidity is not limited to this arrangement. For example, it may be arranged such that a temperature sensor and an absolute humidity sensor are provided so as to substantially detect relative humidity.

Figure 9:
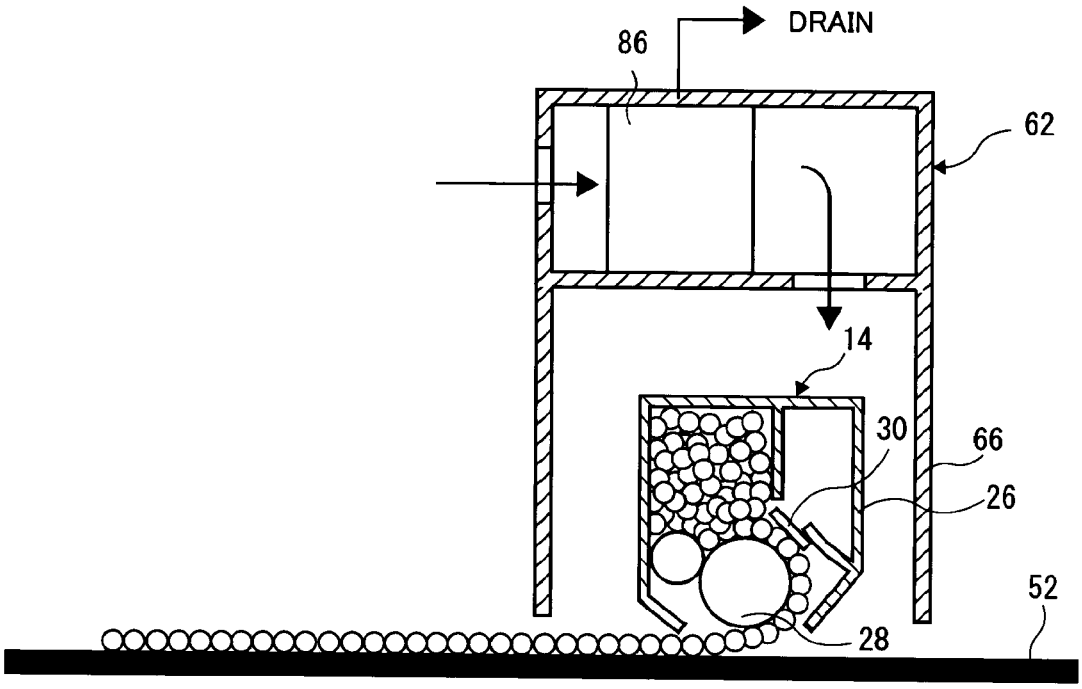
FIG. 9 is a cross-sectional view showing a second particular example of the humidity reduction device in the exemplary embodiment of the present invention.

FIG. 9 is a cross-sectional view showing a second particular example of the humidity reduction device 62. In the second particular example, the blow part 66 is provided with a compressor 86. The compressor 86 compresses air entered the blow part 66. A moisture content bedewed by the compressor 86 is discharged, thereby air in which the relative humidity is reduced is supplied around the particle supply device 14.

Note that already-described constituent elements have the same reference numerals in the figure, and the explanations of those elements will be omitted.

Figure 10:
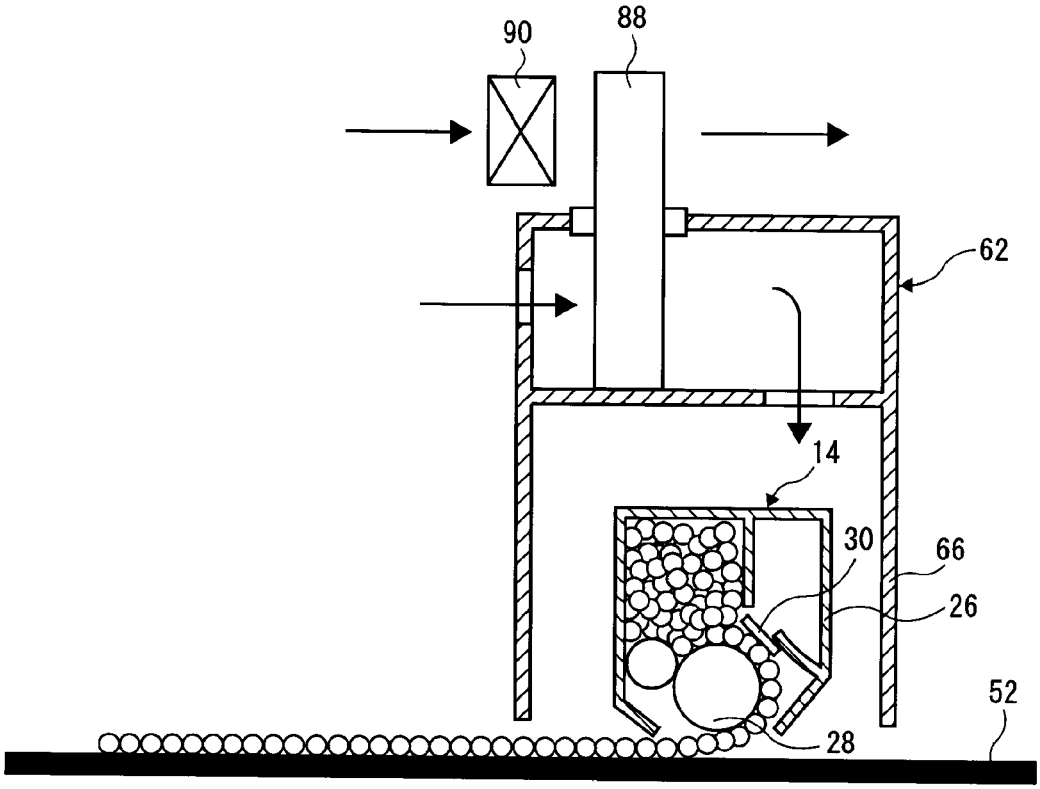
FIG. 10 is a cross-sectional view showing a third particular example of the humidity reduction device in the exemplary embodiment of the present invention.

FIG. 10 is a cross-sectional view showing a third particular example of the humidity reduction device 62. In the third particular example based on the Desiccant method, a desiccant rotor 88 is provided. The desiccant rotor 88 rotates between the inside and the outside of the blow part 66. The desiccant rotor 88, having water absorbing material such as silica gel or zeolite, absorbs a moisture content from air sent to the blow part 66. A heater 90 is provided outside the blow part 66, and air heated by the heater 90 is sent outside the blow part 66 to the desiccant rotor 88, and the moisture content absorbed by the desiccant rotor 88 is withdrawn from the desiccant rotor 88. Note that already-described constituent elements have the same reference numerals in the figure, and the explanations of those elements will be omitted.

Figure 11:
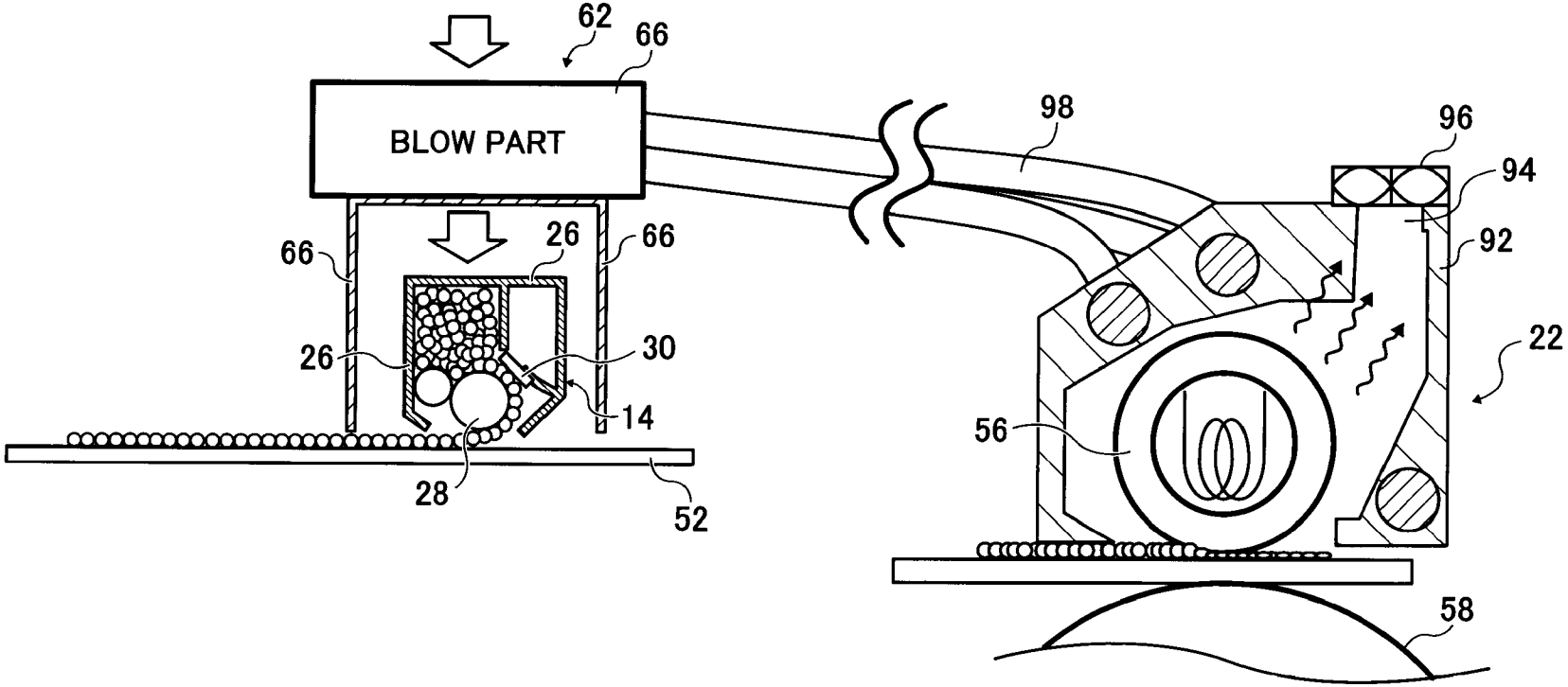
FIG. 11 is a cross-sectional view showing a fourth particular example of the humidity reduction device in the exemplary embodiment of the present invention.

FIG. 11 is a cross-sectional view showing a fourth particular example of the humidity reduction device 62. In the fourth particular example based on a heating method, particularly heat of the fixing device 22 is utilized. That is, the heating roller 56 of the fixing device 22 is covered with a copper or aluminum fixing case 92. A discharge port 94 is formed in an upper part of the fixing case 92, and the discharge air blower 96 is provided at the discharge port 94. When the recording medium 52 on which the liquid recipient particles are transferred is passed through the fixing device 22, the liquid recipient particles are fixed to the recording medium 52 with heat and pressure. At this time, a moisture content evaporates from a heated portion. The evaporated moisture content is discharged to the outside by the discharge air blower 96. Further, in the fixing case 92, a part of the heat pipe 98 is inserted in the fixing case 92. The heat pipe 98 connects the fixing case 92 with the above-described blow part 66. The fixing case 92 is heated by the heating roller 56, and the heat of the fixing case 92 is transmitted via the heat pipe 98 to the blow part 66. The thermal response of the heat pipe 98 is about 90% at e.g. a time point 1 minute after the start of transmission. For example, when the temperature of the fixing case 92 is 80° C., the temperature of the blow part 66 can be 70° C. When the temperature of ambient air and the relative humidity are 30° C. and 90%, air passing through the blow part 66 is heated by the blow part 66, thereby low-humidity air at 60° C. and 20% can be supplied to the particle supply device 14.

Note that already-described constituent elements have the same reference numerals in the figure, and the explanations of those elements will be omitted.

Figure 12:
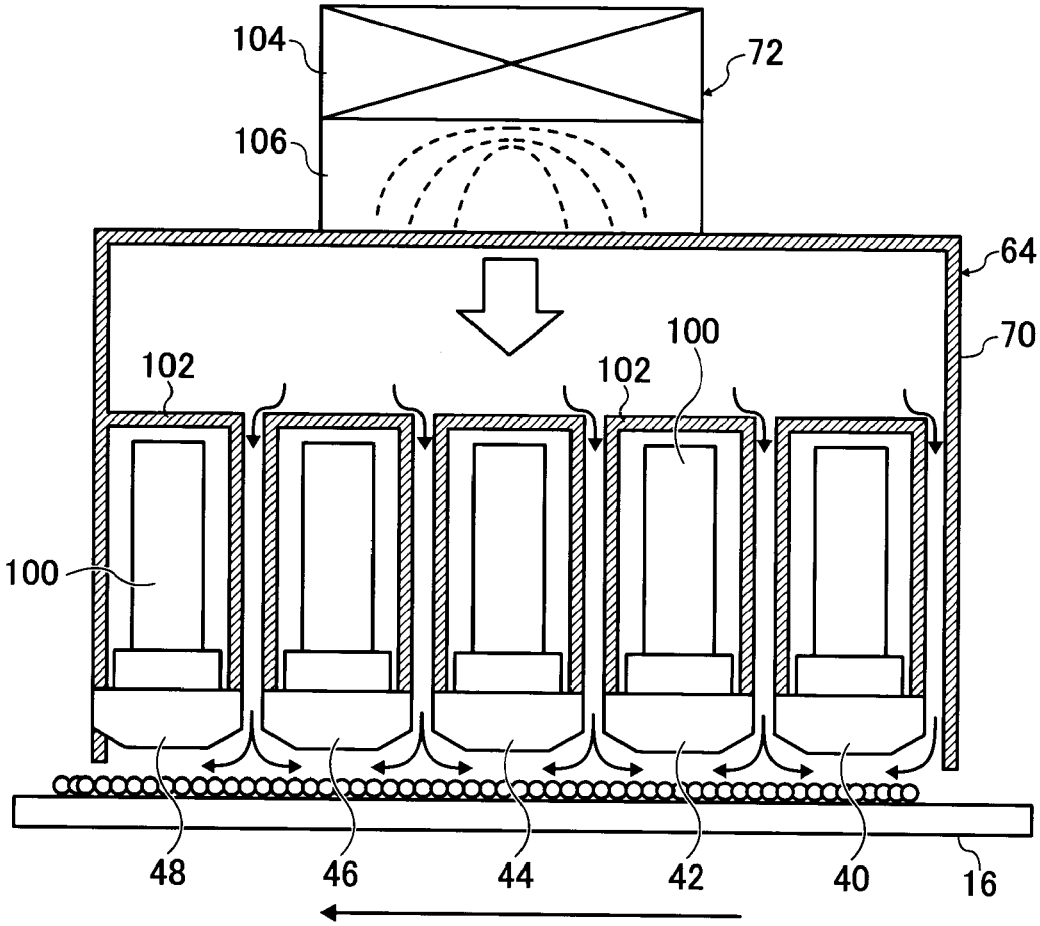
FIG. 12 is a cross-sectional view showing a first particular example of a humidity increasing device in the exemplary embodiment of the present invention.

FIG. 12 is a cross-sectional view showing a first particular example of the humidity increasing device 64. Respective print heads 40 to 48 have a wiring 100, and the periphery of the wiring 100 is covered with a protective case 102. Humidity-increased air flows between the humidity increasing device main body 70 and the protective case 102 or between the protective cases 102, and the wiring 100 is protected with the protective case 102 from high-humidity air. The blow part 72 has an air blower 104 which is a coaxial fan, a silocco fan or the like, and a humidifier 106 to humidify air sent by the air blower 104. The humidifier 106, which is a spray type humidifier in the present exemplary embodiment, having a water tank, a spray and the like, humidifies supplied air. As a spray, a piezoelectric element, a spray or the like is used to vaporize water in the water tank. Note that the humidifier 106 is arranged such that bedewed water is not supplied onto the intermediate transfer body 16 and a bedewed moisture content does not drop in the humidity increasing device main body 70. The air humidified by the humidifier 106 is supplied to the humidity increasing device main body 70, and passed between the humidity increasing device main body 70 and the protective case 102 or between the protective cases 102, and further between the print heads 40 to 48 and the intermediate transfer body 16, and supplied to the discharge orifice 50 of the respective print heads 40 to 48.

Figure 13:
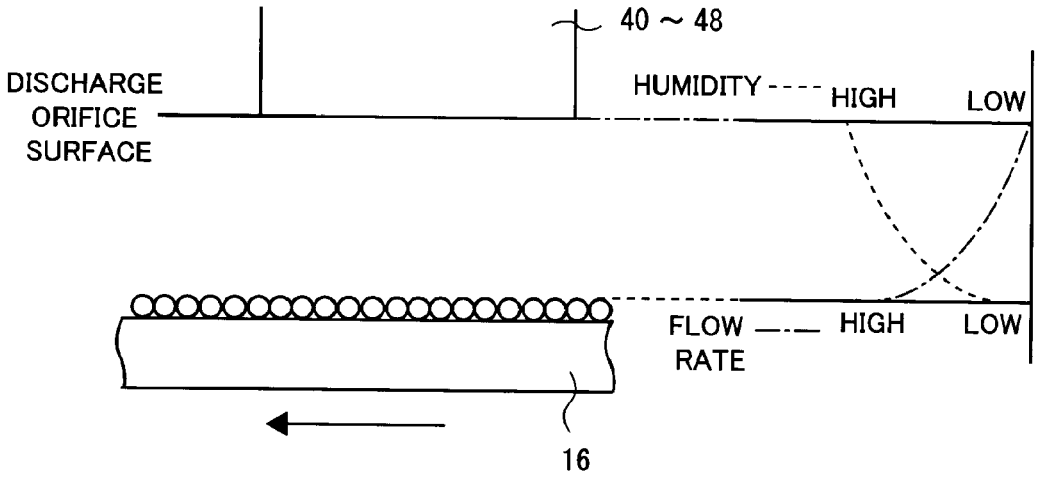
FIG. 13 is a conceptual diagram showing the relation between air flow rate and humidity in space between a discharge orifice surface and the surface of an intermediate transfer body in the exemplary embodiment of the present invention.

FIG. 13 shows the relation between air flow rate and humidity in space between a discharge orifice surface (surface in which the discharge orifice is opened) and the surface of the intermediate transfer body 16. As the intermediate transfer body 16 moves at a predetermined speed (e.g. 0.4 m/s) in an arrow direction in the figure, an air flow at a speed close to the moving speed of the intermediate transfer body 16 occurs around the surface of the intermediate transfer body 16. As the air flow is quickly attenuated toward the discharge orifice surface, it rarely or never carries humidified air away. Accordingly, the high humidity can be maintained near the discharge orifice surface. Note that the liquid recipient particles conveyed with the intermediate transfer body 16 has a moisture absorption characteristic, therefore, the humidity is rapidly reduced toward the intermediate transfer body 16. Note that the temperature of the humidified air is kept at a temperature lower than that of the discharge orifice surface so as not to cause dew condensation on the discharge orifice surface.

Figure 14:
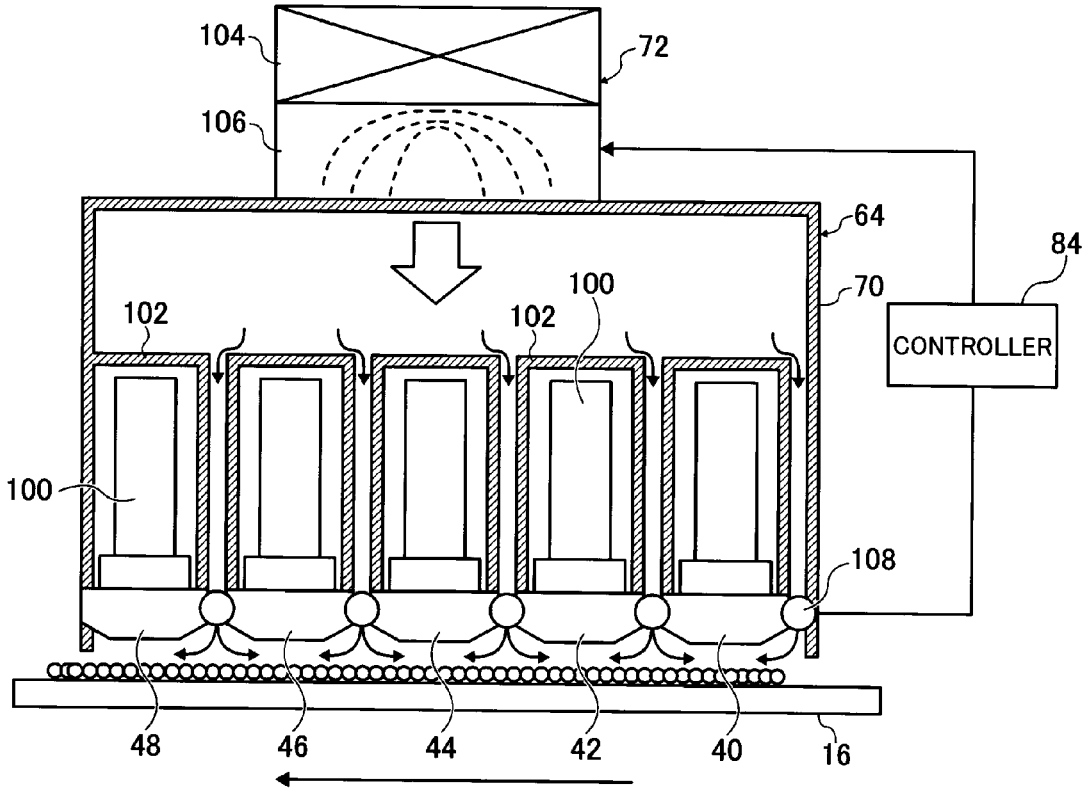
FIG. 14 is a cross-sectional view showing a modification of the first particular example of the humidity increasing device in the exemplary embodiment of the present invention.

The temperature increasing device 64 may always supply humidified air without particular humidity control, however, as shown in FIG. 14, automatic control can be realized by providing a humidity sensor 108. The humidity sensor 108, provided e.g. in a passage of humidified air between the humidity increasing device main body 70 and the protective case 102 or between the protective cases 102 and in the vicinity of the discharge orifice surface, detects the relative humidity of supplied humidified air. The humidity sensor 108 is provided in such position so as to detect humidity approximately equal to that of the discharge orifice surface without influence of air flow by movement of the intermediate transfer body 16. The humidity sensor 108 may be provided in the respective passages of humidified air between the humidity increasing device main body 70 and the protective case 102 or between the protective cases 102, or in one of these positions. The humidity detected by the humidity sensor 108 is inputted into the controller 84 having e.g. a CPU. The controller 84 controls the humidifier 106 based on the humidity detected by the humidity sensor 108.

Figure 15:
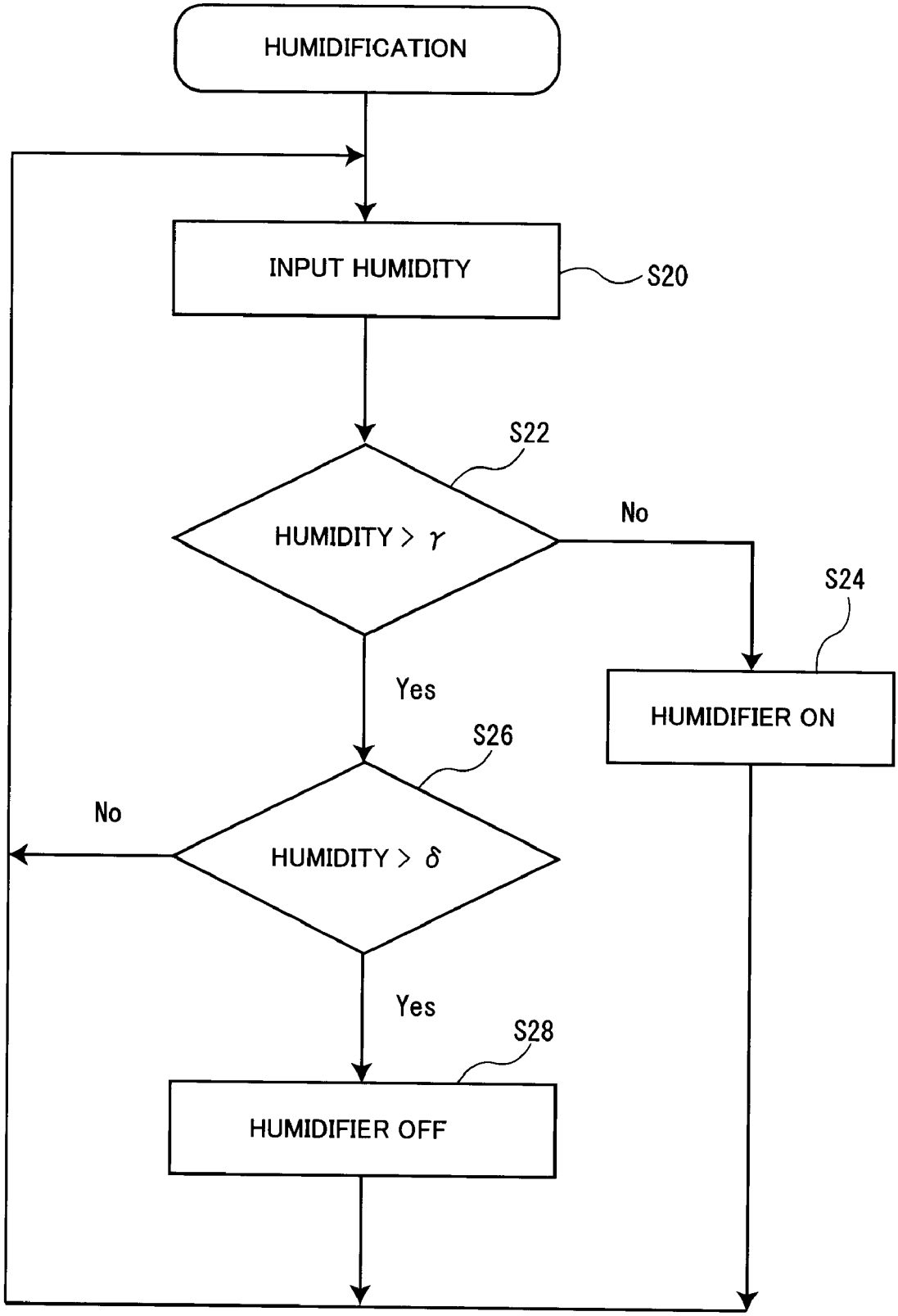
FIG. 15 is a flowchart showing a control operation in the modification of the first particular example of the humidity increasing device in the exemplary embodiment of the present invention.

FIG. 15 is a flowchart showing a control operation of the controller 84. At step S20, the controller 84 inputs humidity from the humidity sensor 108. Next, at step S22, it is determined whether or not the input relative humidity is higher than a predetermined value γ. When it is determined that the input relative humidity is equal to or lower than the predetermined value γ (No), the process proceeds to step S24, at which the humidifier 106 is driven, and the process returns to step S20. On the other hand, when it is determined that the input relative humidity is higher than the predetermined value γ (Yes), the process proceeds to step S26, at which it is determined whether or not the relative humidity inputted at step S22 is higher than a predetermined value δ which is higher than the predetermined value γ and lower than 100%. When it is determined at step S26 that the input relative humidity is higher than the predetermined value δ (Yes), the process proceeds to step S28, at which the driving of the humidifier 106 is stopped, and the process returns to step S20. On the other hand, when it is determined at step S26 that the input relative humidity is equal to or lower than the predetermined value δ (No), the process returns to step S20. The driving of the humidifier 106 is stopped when the relative humidity is higher than the predetermined value δ so as to prevent chattering in energization of the humidifier 106, to reduce energy consumption and to prevent dew condensation.

As a result of this control, air supplied to the discharge orifice 50 of the print heads 40 to 48 is always equal to or higher than the predetermined value γ. The predetermined value γ is e.g. 65%. When the humidified air is equal to or higher than 65%, stable printing can be realized by a general ink-jet printer usage (dummy ink discharge from the discharge orifice is periodically performed to remove bodied up ink due to drying at the discharge orifice). In this case, the amount of evaporation from the discharge orifice is about ½ of that in a non-humidified winter office (=30%). The amount of evaporation is further reduced when the predetermined value γ is 90%. When the humidified air is equal to or higher than 90%, stable printing can be realized without the above-described maintenance of periodical dummy ink discharge from the discharge orifice. In this case, the amount of evaporation from the discharge orifice is about 1/7 of that in the non-humidified winter office (=30%).

Note that in the above-described exemplary embodiment, the driving of the humidifier 106 is ON/OFF controlled, however, the driving is not limited to this arrangement. For example, the level of the driving current supplied to the humidifier 106 may be controlled.

Further, in the above-described exemplary embodiment, the relative humidity is detected by the humidity sensor 108, however, the detection of the relative humidity is not limited to this arrangement. For example, it may be arranged such that a temperature sensor and an absolute humidity sensor are provided so as to substantially detect the relative humidity.

Figure 16:
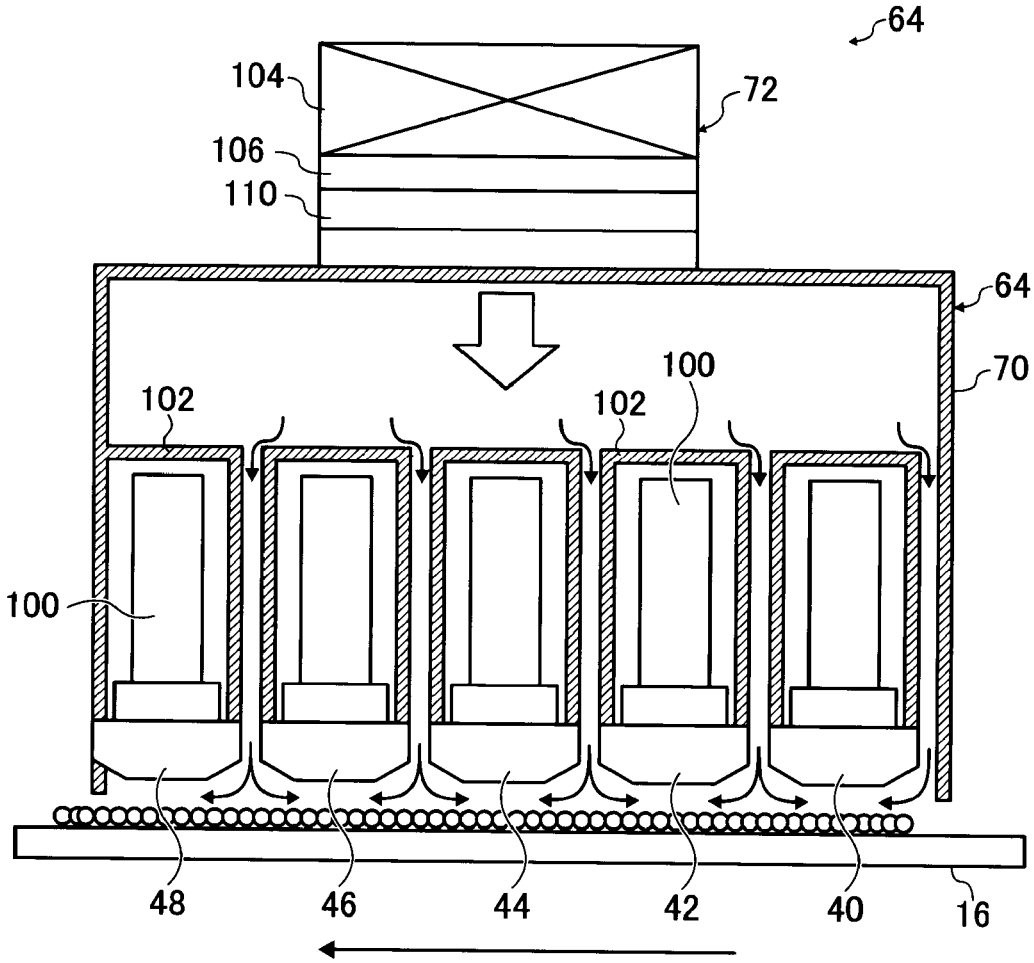
FIG. 16 is a cross-sectional view showing a second particular example of the humidity increasing device in the exemplary embodiment of the present invention.

FIG. 16 is a cross-sectional view showing a second particular example of the humidity increasing device 64. In the second particular example, the humidifier 106 has a water bearing filter 110. The filter 110 is always supplied with water from a water tank or the like. The water in the filter 110 is vaporized bypassing air through the filter 110, thereby the air is humidified.

Note that already-described constituent elements have the same reference numerals in the figure, and the explanations of those elements will be omitted.

Figure 17:
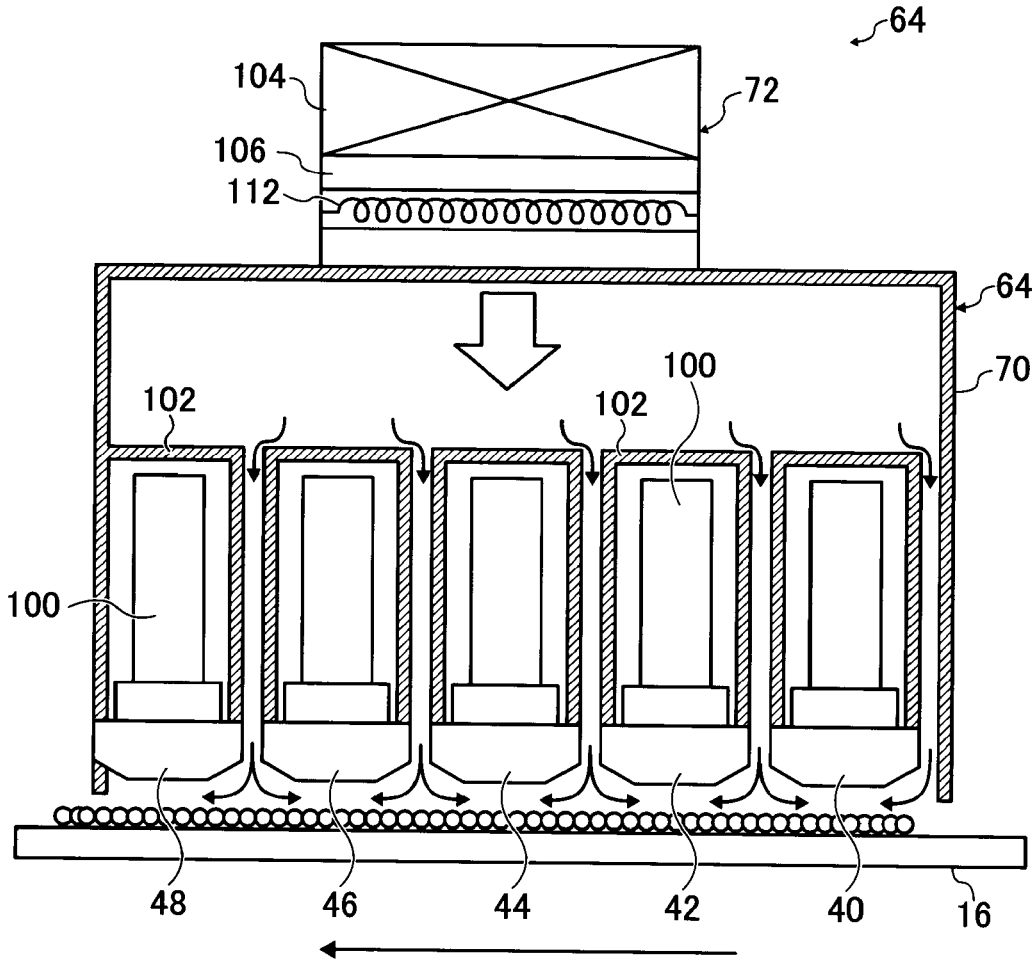
FIG. 17 is a cross-sectional view showing a third particular example of the humidity increasing device in the exemplary embodiment of the present invention.

FIG. 17 is a cross-sectional view showing a third particular example of the humidity increasing device 64. In the third particular example, a heater 112 is provided, and the water in a water tank or a filter is heated thereby vaporized. Supplied air is humidified with the vaporized moisture content. It may be arranged such that heating is performed by heat of the fixing device 22 via the heat pipe 98 shown in FIG. 11 in place of the heater 112.

Note that already-described constituent elements have the same reference numerals in the figure, and the explanations of those elements will be omitted.

Further, various modifications of the humidity increasing device 64 can be provided. For example, the moisture content generated in the humidity reduction device 62 may be evaporated by the methods shown in the first to third particular examples. Further, as the air discharged by the discharge air blower 96 of the fixing device 22, shown in FIG. 11, has high humidity, the air may be sent to the blow part 72. In this case, the moisture content differs in accordance with the image density and the number of recording media to be outputted. When the humidity is lower, the amount of discharge air from the discharge air blower 96 is reduced, so as to suppress the moisture content discharged from the humidity increasing device 64 and supply high humidity air. Further, the air including the moisture content removed from the desiccant rotor 88 shown in FIG. 10 may be sent to the blow part 72.

Figure 18:
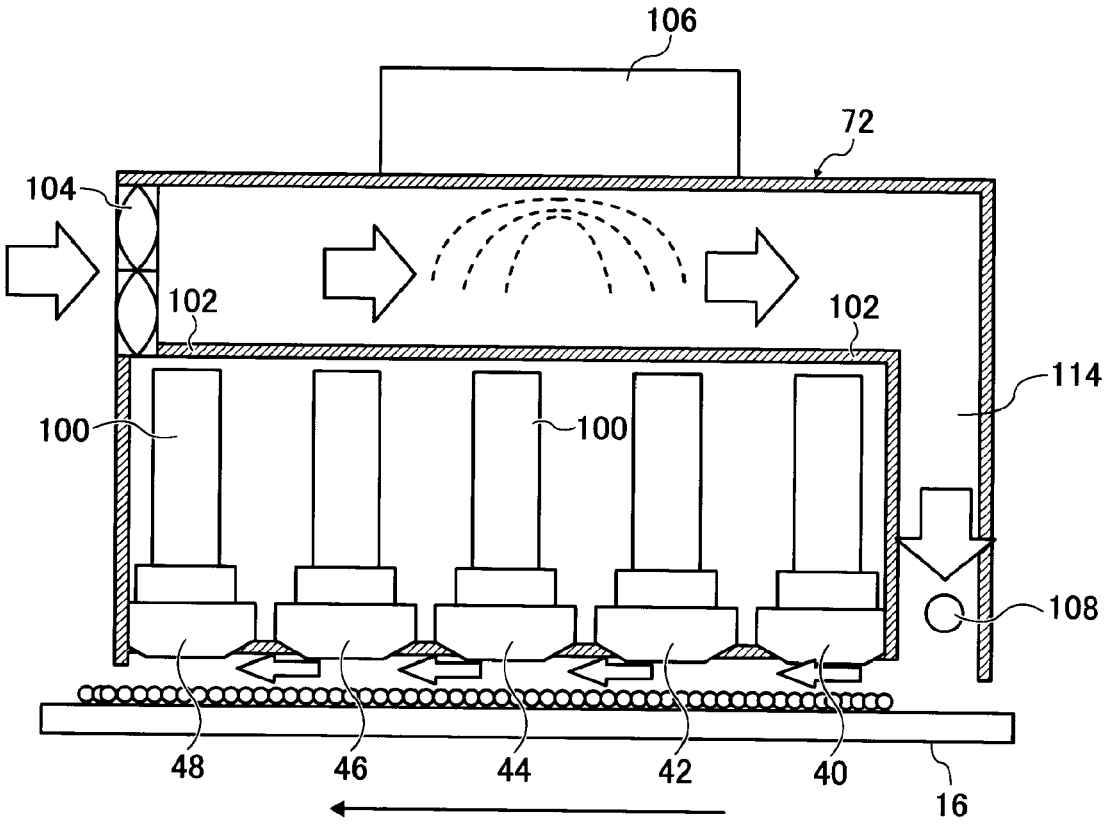
FIG. 18 is a cross-sectional view showing a fourth particular example of the humidity increasing device in the exemplary embodiment of the present invention.

FIG. 18 is a cross-sectional view showing a fourth particular example of the humidity increasing device 64. In the fourth particular example, the blow part 72 has a duct 114 to supply humidified air immediately before the ink-jet printer 18 on the upstream side in the conveyance direction of liquid recipient particles, and further, guide the humidified air to the downstream side of the ink-jet printer 18 in the conveyance direction of the liquid recipient particles. In the duct 114, an air blower 104 which is a coaxial fan, a silocco fan or the like is provided around the entrance of the duct 114, and the duct 114 is opened toward the surface of the intermediate transfer body 16 immediately before the ink-jet printer 18 via the humidifier 106. Accordingly, the humidified air hits the layer of the liquid recipient particles conveyed by the intermediate transfer body 16, and the moisture content is absorbed with the liquid recipient particles. When the moisture content is absorbed with the liquid recipient particles, the surface of the liquid recipient particles is melt, then adhesive power occurs in the liquid recipient particles, then the agglutin ability among the liquid recipient particles is increased, and the movement of the liquid recipient particles on the intermediate transfer body 16 is suppressed. Upon attachment of liquid droplets by the ink-jet printer 18 or upon permeation, movement or flying of the liquid recipient particles can be prevented, and excellent image quality can be obtained.

In the fourth particular example, when humidity is automatically controlled, the humidity sensor 108 is provided in e.g. a position slightly front of the opening of the duct 114 toward the intermediate transfer body 16. When the humidity sensor 108 is provided in this position, the temperature of high-humidity air having the humidity approximately the same as that around the discharge orifice of the print heads 40 to 48 can be infallibly detected with reduced influence of air flow due to movement of the intermediate transfer body 16.

Note that in the above-described exemplary embodiment, an image forming apparatus using the intermediate transfer body 16 has been described, however, the present invention is not limited to this image forming apparatus. For example, it may be arranged such that the intermediate transfer body 16 is not used, i.e., a recording medium is conveyed by a conveyance member in place of the intermediate transfer body 16, the liquid recipient particles are supplied to the recording medium, and liquid droplets are discharged to the liquid recipient particles on the recording medium, thereby an image is formed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a supply unit that supplies liquid receiving particles to receive liquid;

a transporting unit that transports the liquid receiving particles supplied by the supply unit;

a discharge unit that discharges liquid droplets to the liquid receiving particles transported by the transporting unit;

a humidity reducing unit that reduces relative humidity inside or around the supply unit; and a humidity increasing unit, on a downstream side of the supply unit, that increases relative humidity around at least one of the liquid receiving particles transported by the transporting unit and the discharge unit.

2. The image forming apparatus according to claim 1, further comprising:

a first ambient humidity detection unit that detects the relative humidity inside or around the supply unit; and a controller that controls the humidity reducing unit in correspondence with a result of detection by the first ambient humidity detection unit.

3. The image forming apparatus according to claim 2, wherein the controller controls the relative humidity around the supply unit to a level lower than 30%.

4. The image forming apparatus according to claim 1, further comprising:

a second ambient humidity detection unit that detects the relative humidity around at least one of the liquid receiving particles transported by the transporting unit and the discharge unit; and a controller that controls the humidity reducing unit in correspondence with a result of detection by the second ambient humidity detection unit.

5. The image forming apparatus according to claim 4, wherein the controller controls the relative humidity around at least one of the liquid receiving particles transported by the transporting unit and the discharge unit to a level equal to or higher than 65%.

6. The image forming apparatus according to claim 1, further comprising:

a transfer unit that transfers the liquid receiving particles to which the liquid droplets have been discharged by the discharge unit to a recording medium; and a fixing unit that fixes, with at least heat, the liquid receiving particles to the recording medium on which the liquid receiving particles have been transferred by the transfer unit.

7. The image forming apparatus according to claim 6, wherein the humidity reducing unit heats supplied air by utilizing heat discharged from the fixing unit.

8. The image forming apparatus according to claim 6, wherein the humidity increasing unit humidifies supplied air by supplying a moisture content discharged from the fixing unit to the air.

9. The image forming apparatus according to claim 1, wherein the humidity reducing unit is a dehumidification unit.

10. The image forming apparatus according to claim 9, wherein the humidity reducing unit dehumidifies supplied air by causing dew condensation.

11. The image forming apparatus according to claim 9, wherein the humidity reducing unit dehumidifies supplied air by absorbing a moisture content in the air with a moisture absorbent.

12. The image forming apparatus according to claim 1, wherein the humidity reducing unit is a heating unit.

13. The image forming apparatus according to claim 1, wherein the humidity increasing unit is a humidification unit.

14. The image forming apparatus according to claim 13, wherein the humidity increasing unit humidifies supplied air by passing the air through a humidification member including a moisture content.

15. The image forming apparatus according to claim 13, wherein the humidity increasing unit humidifies supplied air by supplying a vaporized moisture content to the air.

16. The image forming apparatus according to claim 1, wherein the humidity increasing unit humidifies supplied air by supplying a moisture content caused by the humidity reducing unit to the air.

17. An image forming method comprising:

supplying liquid receiving particles to receive liquid from a supply unit;

conveying the liquid receiving particles supplied by the supply unit, by a transporting unit;

discharging liquid droplets from a discharge unit to the conveyed liquid receiving particles;

reducing relative humidity inside or around the supply unit; and on a downstream side of the supply unit, increasing relative humidity around at least one of the liquid receiving particles transported by the transporting unit and the discharge unit.

18. The image forming method according to claim 17, wherein the relative humidity inside or around the supply unit is detected, and the relative humidity inside or around the supply unit is controlled in correspondence with a result of detection.

19. The image forming method according to claim 17, wherein the relative humidity around at least one of the liquid receiving particles transported by the transporting unit and the discharge unit is detected, and in correspondence with a result of detection, the relative humidity around at least one of the liquid receiving particles transported by the transporting unit and the discharge unit is controlled.

20. The image forming method according to claim 17, wherein the liquid receiving particles, to which the liquid droplets have been discharged by the discharge unit, are transferred to a recording medium, and the liquid receiving particles are fixed, with at least heat, to the recording medium on which the liquid receiving particles have been transferred.

* * * * *